US005396984A

United States Patent [19]

Wanders

[11] Patent Number: 5,396,984

[45] Date of Patent: Mar. 14, 1995

[54] CONTAINER FOR STORING AT LEAST ONE CONTACT LENS

[75] Inventor: Bernardus F. M. Wanders, Angerlo, Netherlands

[73] Assignee: Procornea Holding B. V., Eerbeek, Netherlands

[21] Appl. No.: 162,050

[22] PCT Filed: Jun. 18, 1992

[86] PCT No.: PCT/NL92/00107

§ 371 Date: Dec. 8, 1993

§ 102(e) Date: Dec. 8, 1993

[87] PCT Pub. No.: WO93/00027

PCT Pub. Date: Jan. 7, 1993

[30] Foreign Application Priority Data

Jun. 24, 1991 [NL] Netherlands ..... 9101083

[51] Int. Cl.[6] ..... B65D 85/38

[52] U.S. Cl. ..... 206/5.1; 206/210

[58] Field of Search ..... 206/5.1, 210

[56] References Cited

U.S. PATENT DOCUMENTS 3,113,579 12/1963 Willis .
3,367,481 2/1968 Tanaka .
3,741,377 6/1973 Krellen .
3,880,278 4/1975 Brown .
3,976,193 8/1976 Dogliotti .
4,091,917 5/1978 Clawson et al. ..... 206/5.1
4,173,281 11/1979 Trought ..... 206/5.1

FOREIGN PATENT DOCUMENTS 0351202 1/1990 European Pat. Off. .
2310940 12/1976 France .
2595667 9/1987 France .

*Primary Examiner*—Jimmy G. Foster
*Attorney, Agent, or Firm*—Young & Thompson

[57] ABSTRACT

A container for storing at least one contact lens (12) comprises at least one receiving means (1), one side wall of which is provided with an opening providing access to a receiving space (11) within the receiving means the contact lens is to be received in, a closing means (2) for closing the opening, and a supporting means (13) being integral with said closing means and serving to support the contact lens. The receiving means (1) comprises two at least substantially flat wall parts (3, 4) and wall joint parts (5, 6, 7) joining said wall parts, while a space defined by said wall parts constitutes the receiving space. Additionally, a contact lens storage apparatus designed for storing a plurality of containers according to the invention is provided.

13 Claims, 3 Drawing Sheets

CONTAINER FOR STORING AT LEAST ONE CONTACT LENS

FIELD OF THE INVENTION

The invention relates to a container for storing a contact lens.

BACKGROUND OF THE INVENTION

Such a container is disclosed in U.S. Pat. No. 3,113,579. In this patent specification supporting means are described being a rectangular frame and comprising two openings for receiving of contact lenses placed adjacent to each other. This storage frame is introduced under pressure in the container in that a screw plug is urged on its upper side. This structure is relatively complicated to fabricate and has a substantial thickness. The first feature results in relatively high manufacturing costs whilst the second one will considerably increase dispatching costs. Contact lenses are centrally produced and shipped on order to opticians by mail. These problems are aggravated when forwarding a plurality of these containers, e.g. from the place of manufacture to customers, such as opticians, training institutes, hospitals, etc., but also in storing relatively large numbers of these containers or during transport of the containers, for example, by customers or contact lens specialists.

Another state-of-the-art container for storing contact lenses also comprises a cylindrical receiving means, yet its cap abuts on the cylindrical receiving means as a snap fastening device, so as to close it. The lens is not supported by a supporting means yet is submerged or floats in the conditioning solution. This presents the problem that when removing the lens from the container a finger tip will contact the conditioning solution, so that the receiving means of the container gets easily soiled.

As for both known types of containers, the receiving means, which is designed to contain a conditioning solution, is to be closed on the periphery by means of the cap abutting on the receiving means. Practice showed that when the lens has to stay for a relatively longer period of time in the container some of the solution evaporates, so that therefore the remaining part of the solution thickens. For this reason, these known containers are not suitable for storing the lens for several days, weeks or months. Besides, it appears that after frequent use leaks may occur, as might take place, for example, when the container is transported in such a manner that the solution is near the opening of the receiving space. Moreover, refraction at the container's cylindrical surface makes it hard to catch any sight of the lens, or, if any, it would be distorted, the visibility being hindered even more when the container is,provided with a data-carrying label.

SUMMARY OF THE INVENTION

The present invention aims to eliminate the above-described drawbacks, and to this end a container for storing at least one contact lens and comprising at least one receiving means, one side wall of which is provided with an opening providing access to a receiving space within the receiving means the contact lens is to be received in, a closing means for closing the opening, and a supporting means being integral with said closing means and serving to support the contact lens. The receiving means comprises two at least substantially flat wall parts and wall joint parts joining said wall parts, while a space defined by said wall parts constitutes the receiving space. Additionally, a contact lens storage apparatus designed for storing a plurality of containers according to the invention is provided.

Thanks to such a design the container can be extremely compact, while the geometrical shape is such that also dispatch or storage of a plurality of such containers can be efficient in practice.

Preferably, the wall parts are mutually substantially parallel, the distance between the two wall parts being considerably smaller than an average length covered by each of the wall parts. Thus, on the one hand a receiving space is defined which is related to and closely corresponds to the dimensions of a contact lens, so that a relatively small amount of solution will suffice, while on the other hand the selected design of the container optimizes storage, dispatch, or transport to an even greater extent, particularly in the case of a plurality of containers.

The closing means may comprise an inner part designed to be inserted into the opening, as well as an outer part which is connected to said inner part and which is positioned, in closed position, outside the receiving space. As in this way a portion of the closing means is inserted right into the opening, a proper closure of the container's receiving space can be obtained, while the outer part allows the closing means to be easily removed.

It is preferred that the closing means is made of a resilient material, preferably a styrene-butadiene elastomer sold under the trademark KRATON and that at least two sealing edges are provided on the periphery of the inner part of the closing means. Thus, the second sealing edge constitutes an additional seal for the receiving means.

It is also preferred that, in a direction at least perpendicular to the wall parts, the outer part of the closing means is of a dimension that is at least virtually equal to the distance between the opposed sides of the wall parts near the outer part of the closing means. As a result, the closing means fits the receiving means perfectly, thus preventing an accidental loosening of the closing means from the receiving means. As part of the safeguard, the receiving means may be provided, at least near the outer part of the closing means, with edge parts which surround the outer part of the closing means, at least partly. Each of these edge parts may include an end face being, in closed position, coplanar with the side of the outer part of the closing means facing away from the receiving space, thus resulting in a perfect alignment.

When considering the invention in detail, it shows that a locking means is provided, comprising securing means for co-operation with related securing means being integral with each of the end faces of the edge parts, so as to lock the closing means in closed position. Moreover, on the side of the outer part of the closing means facing away from the receiving space a recess may be arranged which serves to receive the locking means, at least partly.

According to a preferred embodiment of the apparatus of the invention, one of the wall parts covers a considerably larger surface than the other wall part, while the wall joint parts extend substantially perpendicular to the wall parts. This results in the feature that the one wall part includes a projecting portion extending at least from the wall joint part opposite the closing means, said projecting portion being provided with a data carrier. In this way, the container for storing a contact lens may be provided with data, such as information as to the contact lens itself, without affecting the good visibility due to the flat wall parts—in the case of a transparent container.

To seal the container a sealing means may be provided which covers at least the closing means and at least one of the two wall parts. As the wall parts are substantially flat, they provide a good bonding surface for the sealing means.

The invention also relates to an apparatus for storing contact lenses in a plurality of storage containers according to the invention.

BRIEF DESCRIPTION OF THE DRAWINGS

Additional features and merits of the container according to the present invention will be clearly revealed in the following description with reference to the drawings, in which.

DETAILED DESCRIPTION OF THE INVENTION

Figure 1:
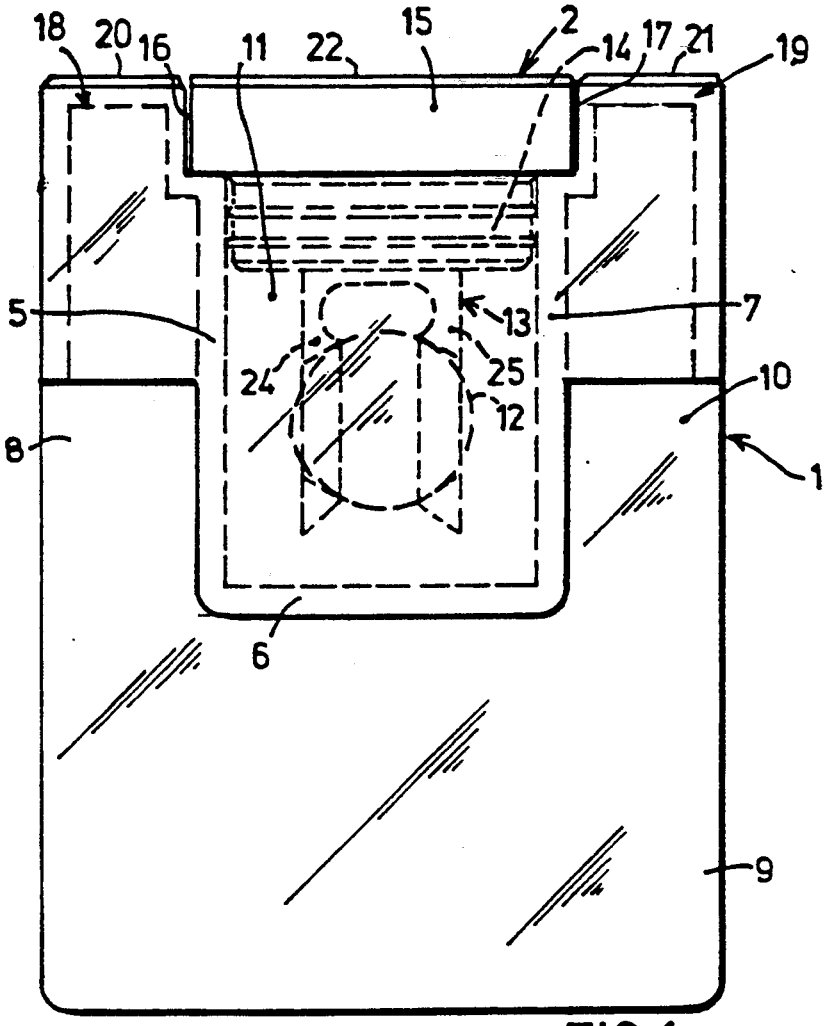
FIG. 1 is a front view of a preferred embodiment of the container for storing contact lens of according to the invention.

Corresponding components are consistently indicated in the figures by identical reference characters.

FIG. 1 shows a preferred embodiment of a container according to the invention, which is particularly suitable for storing hard, gas permeable contact lenses. The container comprises a receiving means 1 as well as a closing means in the form of a cap 2. The receiving means 1 comprises two parallel, flat wall parts 3 and 4 (see also FIG. 2), as well as wall joint parts 5, 6, and 7 joining said wall parts, said wall joint parts extending perpendicular to the wall parts 3 and 4. The wall part 4 covers a considerably larger surface than the wall part 3 due to the projecting parts 8, 9, and 10 extending from their respective wall joint parts 5, 6, and 7. The wall parts 3 and 4 combined with the wall joint parts define a space 11 constituting a receiving space for a contact lens 12. Moreover, the space 11 is suitable for containing a solution, e.g. a conditioning solution. In the receiving space the contact lens 12 is supported by a supporting means 13 being integral with the cap 2 covering said receiving space 11. The cap 2 is represented as a separated part in FIG. 3.

Figure 2:
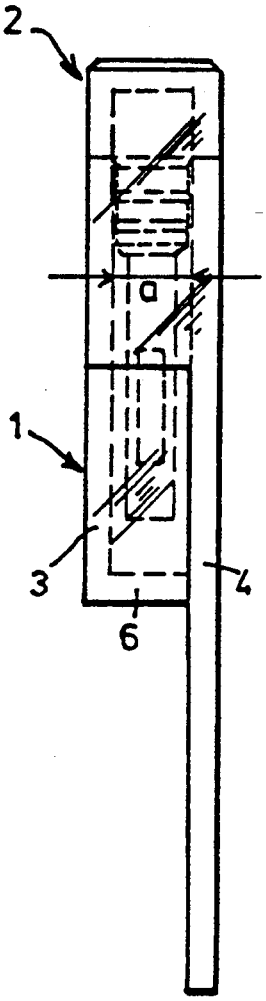
FIG. 2 is a side view of the container according to FIG. 1.
Figure 3:
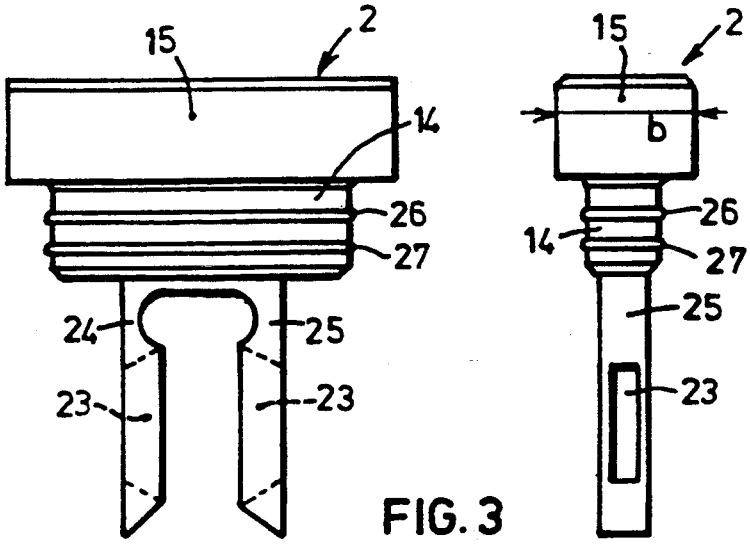
FIG. 3 provides a front view as well as a side view of the closing means according to FIG. 1.

As FIGS. 1 and 2 show, the distance a between the inner sides of the wall parts 3 and 4 is considerably smaller than the smallest length or width of each of the wall parts 3 and 4, in this case by a factor of four.

The cap 2 comprises an inner part 14 which is designed to be inserted through the opening into the receiving space 11, as well as an outer part 15 which is to remain outside the receiving space 11. The cap is made of a resilient material. The dimension b of the outer part of the cap, that is its thickness as measured in the direction perpendicular to the wall parts 3 and 4 (see FIG. 3) is equal to the distance between the outer sides of the wall parts 3 and 4. The outer part 15 of the cap 2 is surrounded at its side faces 16 and 17 by edge parts 18 and 19 of the receiving means 1. Edge parts 18 and 19 include end faces 20 and 21 which are coplanar with the outer side 22 of the cap 2, thus the cap 2 is counter-sunk in the receiving means 1.

The supporting means 13 comprises two legs 24 and 25 provided with conical recesses 23. The supporting means 13 is integral with the closing means 2, and therefore it is made of the same resilient material. The lens 12 can be fitted into the supporting means by spreading the legs 24 and 25 slightly apart. In a similar manner the lens may be removed from the supporting means.

A secure seal of the receiving space is due to the cap 2 which is provided with two sealing edges 26 and 27 on the periphery of the inner part 14.

Figure 4:
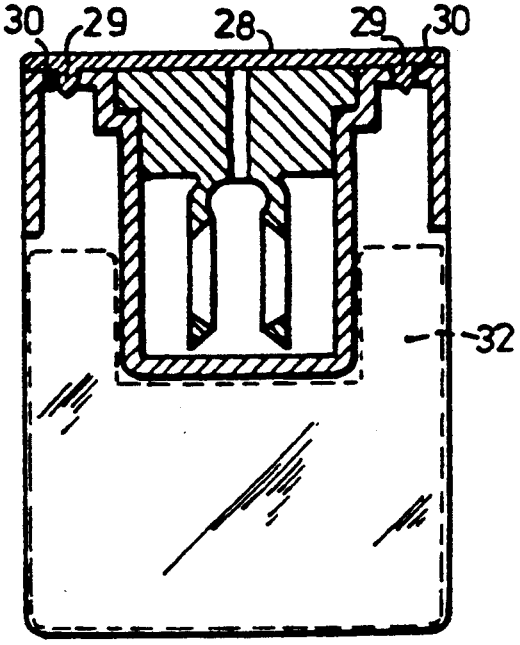
FIG. 4 is a longitudinal view of a variant embodiment of the container according to FIG. 1.
Figure 5:
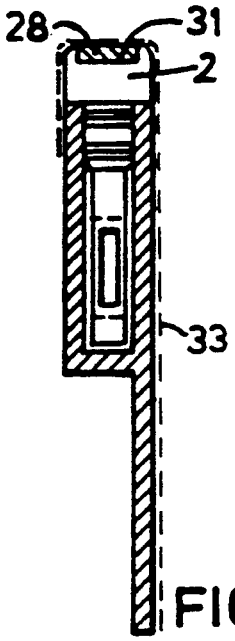
FIG. 5 is a side view of the container according to FIG. 4.

FIG. 4 shows a longitudinal view of a variant embodiment of the apparatus according to FIG. 1, comprising a locking means including a strip 28 provided with fastening means in the form of pins 29 mating as a snap fastening device with the openings 30 arranged in the end surfaces 20 and 21. In this way, the cap 2 may be locked by the strip 28. FIG. 5 shows that in the cap's outer side 22 a recess 31 is provided so as to receive the strip 28.

Figure 6:
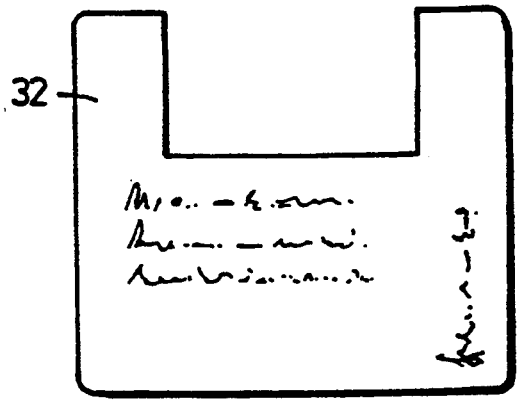
FIG. 6 shows a data carrier which is suited to being applied to the container according to FIG. 1 or 4.

FIG. 6 shows an example of a data carrier 32 being provided at the rear with a self-adhesive material and having dimensions corresponding to those of the projecting parts 8, 9, and 10 of the wall part 4 (see also FIG. 4). On the data carrier 32, the design of which allows any recognizable color, data may be printed which reveal the features of the contact lens 12 to be stored.

Figure 7:
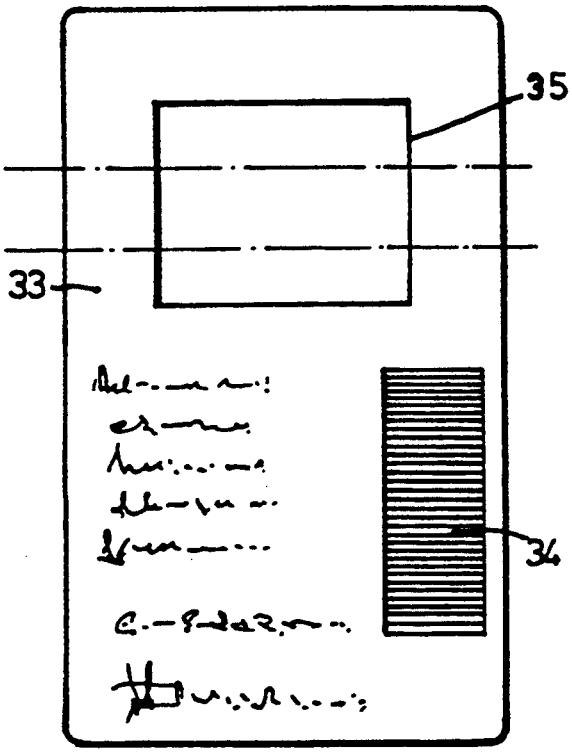
FIG. 7 shows a sealing means which is suited to being applied to the container according to FIG. 1 or 4.

FIG. 7 shows a sealing means 33 which is provided at the rear with an adhesive material just like the data carrier 32 and which has the right dimensions to fit over the cap 2 and each of the wall parts 3 and 4, as is indicated in FIG. 5 by dashed lines. On the sealing means 33 data concerning the lens, such as diameter, dioptre, asphericality, eccentricity, and prism may be printed, combined with a bar code 34 for the sake of identification. In order to break the sealing in a simple, clearly visible and irreversible manner, the sealing means 33 is provided with microperforations, at least at the section corresponding to the position of the cap 3 which is indicated by a section line 35.

Figure 8:
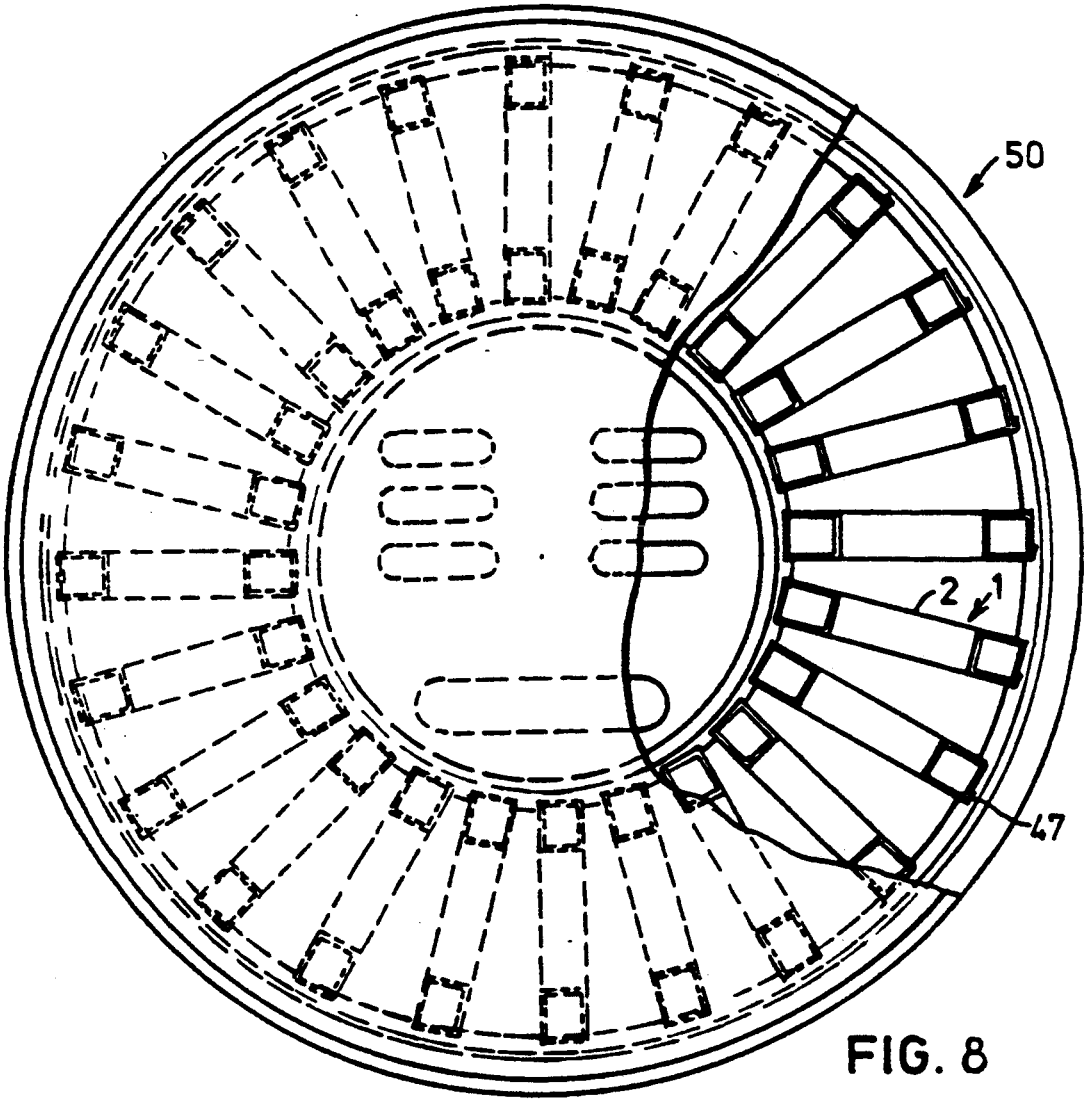
FIG. 8 is a, partly cut-away, top view of a second embodiment of the apparatus for storing contact lenses according to the invention.
Figure 9:
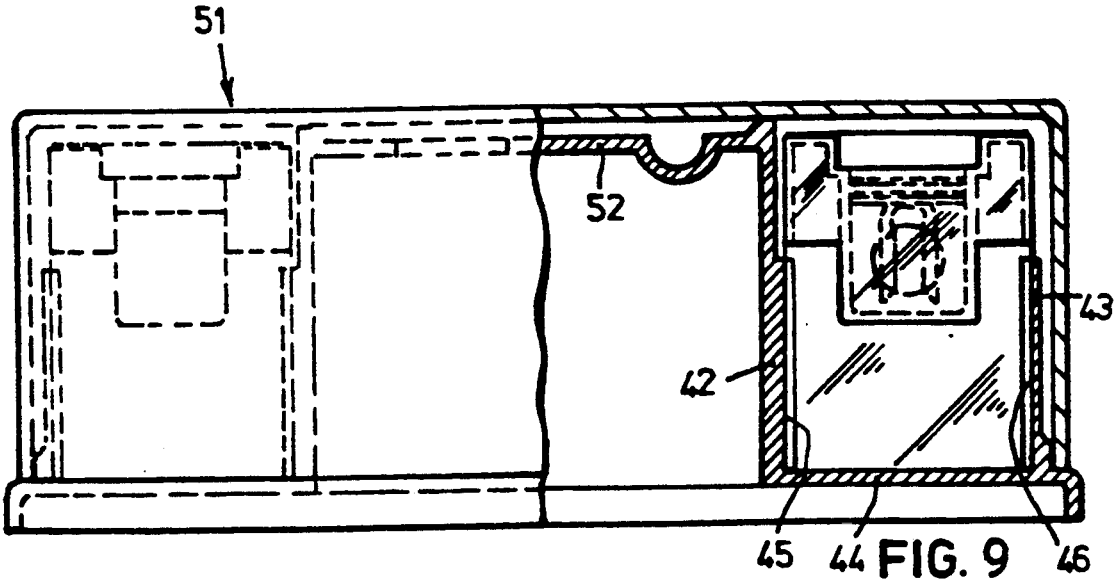
FIG. 9 is a schematic, partly cross-sectional, side view of the apparatus according to FIG. 8.

To store a plurality of containers according to the invention, the invention provides a device for storing contact lenses as, is represented in FIGS. 8 and 9.

FIG. 8 shows an embodiment of the apparatus for storing contact lenses, comprising a carrying means 50 which is annular and which can be covered by a tailor-made, removable cap 51, In the center a plate-shaped part 52 As provided which serves as an occasional place for the removed caps 2 when trying a contact lens that fits the eye. 42 and 43 indicate two opposed vertical walls and wall-joined means 44 are provided. On the opposite sides 45 and 46 of the walls 42 and 43 slots 47 are provided in such a matter that a pair of opposed slots is suitable for receiving a container according to the invention at its projecting parts 8, 9 and 10 as is indicated by the chain lines in FIGS. 8 and 9.

It will be obvious to those skilled in the art that several alternatives to the above-described embodiments era feasible within the scope of the invention. The container may, for example, also be provided with two receiving means for storing a pair of contact lenses.

I claim:

1. Container for storing at least one contact lens, comprising a receiving means, having a side wall provided with a substantially rectangular opening providing access to a receiving space within the receiving means, a closing means for closing the opening, said closing means, comprising an inner sealing part which has to be introduced in the opening and an outer gripping part positioned, in closed position, outside the receiving space, wherein the receiving means comprises two substantially flat parallel spaced wall parts interconnected by wall joint parts, and wherein supporting means are provided to support the contact lens, the outer gripping part of the closing means being substantially rectangular, comprising two substantially parallel spaced relatively long side faces and two interconnecting relatively short side faces wherein the distance between the relatively long side faces substantially corresponds with the external distance between the wall parts, wherein the receiving means is provided near the outer gripping part of the closing means with edge parts which partially surround the outer gripping part of the closing means, and wherein the supporting means are integral with the outer gripping part.

2. Container according to claim 1, wherein a sealing means is provided which covers at least the closing means as well as one of the two wall parts.

3. Container according to claim 1, wherein each of the edge parts includes an end face, said end faces being coplanar, in closed position, with the side of the outer part of the closing means facing away from the receiving space.

4. Container according to claim 1, wherein one of the wall parts covers a considerably larger surface than the other wall part, the wall joint parts extending substantially perpendicular to the wall parts.

5. Container according to claim 4, wherein one wall part includes a projecting portion extending at least from the wall joint part opposite the closing means.

6. Container according to claim 5, wherein the projecting portion is provided with a data carrier.

7. Container according to claim 1, wherein the closing means is made of a resilient material.

8. Container according to claim 1, wherein the periphery of the inner part of the closing means is provided with at least two sealing edges.

9. Container according to claim 1, wherein the supporting means comprises two legs each provided with recesses.

10. Container according to claim 9, wherein on the side of the outer part of the closing means facing away from the receiving space a recess is arranged which serves to receive the locking means, at least partly.

11. Container according to claim 1, further including a locking means comprising securing means for cooperation with related securing means being integral with each of the end faces of the edge parts, so as to lock the closing means in closed position.

12. Apparatus for storing contact lenses comprising a carrying means comprising two opposed vertical walls while recesses are provided on the sides of the walls facing one another, a pattern of pairs of recesses being designed for receiving a plurality of containers according to claim 1, the carrying means being annular.

13. Apparatus according to claim 12, comprising a cap being removably arranged over the carrying means.

* * * * *